US008507884B2

(12) United States Patent
Swain et al.

(10) Patent No.: US 8,507,884 B2
(45) Date of Patent: Aug. 13, 2013

(54) ELLIPTICAL LIGHT SOURCE FOR ULTRAVIOLET (UV) CURING LAMP ASSEMBLIES

(75) Inventors: Pradyumna Kumar Swain, North Potomac, MD (US); Darrin Leonhardt, Gaithersburg, MD (US); David Allen Sprankle, Hagerstown, MD (US); Charles H. Wood, Rockville, MD (US)

(73) Assignee: Heraeus Noblelight Fusion UV Inc., Gaithersburg, MD (US)

( * ) Notice: Subject to any disclaimer, the term of this patent is extended or adjusted under 35 U.S.C. 154(b) by 0 days.

(21) Appl. No.: 13/344,240

(22) Filed: Jan. 5, 2012

(65) Prior Publication Data

US 2012/0168648 A1 Jul. 5, 2012

Related U.S. Application Data

(60) Provisional application No. 61/429,799, filed on Jan. 5, 2011.

(51) Int. Cl.
*G21K 5/04* (2006.01)
*G21K 5/02* (2006.01)

(52) U.S. Cl.
USPC ..... 250/504 R; 250/493.1

(58) Field of Classification Search
USPC ..... 250/504 R, 504 H
See application file for complete search history.

(56) References Cited

U.S. PATENT DOCUMENTS

| | | | | |
|---|---|---|---|---|
| 4,924,599 | A * | 5/1990 | Bubley | 34/278 |
| 4,935,335 | A * | 6/1990 | Fotland | 430/324 |
| 5,146,134 | A * | 9/1992 | Stadler et al. | 313/579 |
| 6,720,566 | B2 * | 4/2004 | Blandford | 250/504 R |
| 2004/0037081 | A1 * | 2/2004 | Blandford | 362/283 |
| 2004/0067037 | A1 * | 4/2004 | Tausch et al. | 385/141 |
| 2009/0027892 | A1 * | 1/2009 | Bremerich et al. | 362/297 |
| 2009/0314966 | A1 * | 12/2009 | Garcia | 250/504 H |
| 2011/0002058 | A1 * | 1/2011 | Leonhardt | 359/869 |

* cited by examiner

*Primary Examiner* — Nikita Wells
*Assistant Examiner* — Johnnie L Smith
(74) *Attorney, Agent, or Firm* — Lowenstein Sandler LLP

(57) ABSTRACT

A light source having a substantially elliptical cross-section for UV curing lamp assemblies is disclosed. The light source has a pair of end sections and a central section of smaller diameter than the end sections. The end sections are each connected to the central section by a tapered section the diameter of each of which decreases from an end that mates with an end section toward an end that mates with the central section. Each of the end sections has a substantially elliptical cross-section. The central section and the tapered sections may have a substantially elliptical cross-section. The aspect ratio of the elliptical cross-section of the end sections and the central section of the light source is preferably about 2:1.

15 Claims, 19 Drawing Sheets

ELLIPTICAL LIGHT SOURCE FOR ULTRAVIOLET (UV) CURING LAMP ASSEMBLIES

CROSS-REFERENCE TO RELATED APPLICATION

This application claims the benefit of U.S. provisional patent application No. 61/429,799 filed Jan. 5, 2011, the disclosure of which is incorporated herein by reference in its entirety.

FIELD OF THE INVENTION

The invention relates generally to ultraviolet (UV) curing lamp assemblies, and more particularly, to an elongated microwave-powered light source having a substantially elliptical cross-section for UV curing lamp assemblies.

BACKGROUND OF THE INVENTION

Radiant energy is used in a variety of manufacturing processes to treat surfaces, films, and coatings applied to a wide range of materials. Specific processes include but are not limited to, curing (i.e., fixing, polymerization), oxidation, purification, and disinfection. Processes using radiant energy to polymerize or effect a desired chemical change is rapid and often less expensive in comparison to a thermal treatment. The radiation can also be localized to control surface processes and permit preferential curing only where the radiation is applied. Curing can also be localized within the coating or thin film to interfacial regions or in the bulk of the coating or thin film. Control of the curing process is achieved through selection of the radiation source type, physical properties (for example, spectral characteristics), spatial and temporal variation of the radiation, and curing chemistry (for example, coating composition).

A variety of radiation sources are used for curing, fixing, polymerization, oxidation, purification, or disinfections due to a variety of applications. Examples of such sources include but are not limited to, photon, electron, or ion beam sources. Typical photon sources include but are not limited to, arc lamps, incandescent lamps, electrodeless lamps, and a variety of electronic (i.e., lasers) and solid-state sources. Conventional arc type UV lamp systems and microwave-driven UV lamp systems use tubular bulb envelopes made of fused quartz glass or fused silica.

FIG. 1A is a perspective view of a UV curing lamp assembly 10 showing an irradiator 12 and a light shield assembly 14 in the prior art. FIG. 1B is a partial cross-sectional view of the lamp assembly 10 of FIG. 1A showing a half-elliptical primary reflector 16 and a light source 20 of circular cross-section. FIG. 1C is a partial cross-sectional internal view of the light shield assembly 14 of FIG. 1A showing a half-elliptical primary reflector 16 and a light source 20 of circular cross-section mated to a secondary reflector 25 and end reflectors 26.

Referring now to FIGS. 1A-1C, the UV curing lamp assembly 10 includes an irradiator 12 and a light shield assembly 14. The irradiator 12 includes a primary reflector 16 having a generally smooth half-elliptical shape studded with a pair of RF slot openings 18 for receiving microwave radiation to excite a light source 20 (to be discussed hereinbelow), and a plurality of openings 22 for receiving air flow to cool the light source 20. The light source 20 includes a lamp (e.g., a modular lamp, such as a microwave-powered lamp having a microwave-powered bulb (e.g., tubular bulb with a generally circular cross-section) with no electrodes or glass-to-metal seals). The light source 20 is placed at the internal focus of the half-ellipse formed by the primary reflector 16. The light source 20 and the primary reflector 16 extend linearly along an axis in a direction moving out of the page (not shown). A pair of end reflectors 24 (one shown) terminate opposing sides of the primary reflector 16 to form a substantially half-elliptical reflective cylinder. The light shield assembly 14 of FIG. 1A-1C includes a secondary reflector 25 having a substantially smooth elliptical shape. A second pair of end reflectors 26 (one shown) terminates opposing sides of the secondary reflector 25 to form a substantially half-elliptical reflective cylinder.

A work piece tube 28 of circular cross-section is received in circular openings 30 in the end reflectors 26. The center of the openings 30 and the axis of the work piece tube 28 are typically located at the external focus of the half-ellipse formed by the primary reflector 16 (i.e., the internal focus of the half-ellipse formed by the secondary reflector 25). The work piece tube 28 and the secondary reflector 25 extend linearly along an axis in a direction moving out of the page (not shown).

FIG. 2A is a perspective view of a tubular light source 20 having a generally circular cross-section in the prior art for use with the UV curing lamp assembly 10 of FIG. 1A-1C. FIG. 2B is a perspective view of a primary reflector 16 with the tubular light source 20 of FIG. 2A inserted therein, the primary reflector 16 having openings for receiving microwave radiation to excite the light source 20 and openings for receiving air flow to cool the light source 20 for use with the UV curing lamp assembly of FIG. 1A-1C. Referring now to FIGS. 1A-2B, the light source 20 (e.g., an electrodeless bulb 20 or arc lamp 20) has a pair of end sections 31 and a center section 32 that has a tapered shape, the end sections 31 and the center section 32 each having generally circular cross-section. The light source 20 is filled with a gas. The light source 20 has a pair of short quartz stubs 34 of having a substantially circular cross-section at either end to provide mechanical support for quick mounting into spring-loaded receptacles (holes) 36 located in the end reflectors 24. These stubs 34 are not electrodes and have no electrical function. Arc lamps are energized through electrodes at each end.

The light source 20 is placed at the internal focus of the half-ellipse formed by the primary reflector 16. The light source 20 and the primary reflector 16 extend linearly along an axis in a direction moving out of the page (not shown). A pair of end reflectors (not shown) terminates opposing sides of the primary reflector 16 to form a substantially half-elliptical reflective cylinder, and have slots (not shown) configured for receiving the stubs 34 of light source 20.

In operation, gas in the light source 20 is excited to a plasma state by a source of radio frequency (RF) radiation, such as a magnetron (not shown) located in the irradiator 12. The atoms of the excited gas in the light source 20 return to a lower energy state, thereby emitting ultraviolet light (UV). Ultraviolet light rays 38 radiate from the light source 20 in all directions, striking the inner surfaces of the primary reflector 16, the secondary reflector 25, and the end reflectors 24, 30. Most of the ultraviolet light rays 38 are reflected toward the central axis of the work piece tube 28. The light source 20 and reflector design are optimized to produce the maximum peak light intensity (lamp irradiance) at the surface of a work product (also propagating linearly out of the page) placed inside the work piece tube 28.

When the plasma in the light source 20 is excited and produces UV radiation, the surface of the light source 20 becomes very warm. Cooling air enters a reflector cavity 40 formed by the primary reflector 16, the secondary reflector 25, and the end reflectors 24, 30 through the pair of RF slot openings 18 and the plurality of openings 22 in the primary reflector 16 and flows across the light source 20 at sufficient volume to maintain the light source 20 at its optimum temperature. Sufficient air must be drawn through the reflector cavity 40 to maintain the bulb envelope temperature below a critical temperature of 900-1000° C. In arc lamps, the electrode seals must be maintained at an even lower temperature. At higher temperatures, the lifetime of the light source 20 may be reduced. UV output power for both microwave-powered lamp systems and arc-driven UV lamp systems is limited only by how much cooling can be provided to the light source 20. UV lamps that operate at higher power levels are more desirable, since they can cure a work product (e.g., coatings) at a faster rate, making them more productive.

Either an integral blower (mounted on the irradiator 12) or a remote blower may be used to provide cooling air. It is desirable to reduce the amount of cooling air needed to sufficiently cool the light source 20. As a result, the blower speed or the blower size may be reduced as well. For certain environments, a lower blower speed or smaller blower size advantageous, since such a blower outputs a lower noise level.

The optics generally used in UV systems incur compromises relating to the diameter of the light source 20. Larger bulb diameters may be operated at higher power levels because they have more surface area and therefore require less cooling for a given power input. However, the collection efficiency of reflective optics is not as high with larger diameter bulbs. When elliptical reflectors are used to collect and focus UV radiation from the light source 20 onto a work product, the higher the collection efficiency and the higher the peak irradiance developed at a working plane which includes the work product, the faster the work product may be cured.

Unfortunately, not only do larger bulbs not focus to as high an irradiance level due to divergence, they also block a bit more of the reflected UV radiation from the apex 40 of the ellipse formed by primary reflector 16 due to their larger diameter. Some of the UV radiation that is directed back at the light source 20 becomes trapped in the plasma and does not contribute to the UV output of the light source 20.

As discussed above, current electrodeless bulbs that emit ultraviolet radiation for curing work pieces have an elongated cylindrical shape of circular cross-section. When the light source 20 containing a gas is excited with microwave radiation, a plasma develops which causes the surface of the bulb to heat up to high temperatures. The bulb is generally air cooled through the primary reflector 16 on one side of the light source 20, which causes the other side of the light source 20 to not receive proper cooling. This causes the light source 20 to develop hot spots which reduces the life of the bulb.

The aforementioned problems with cooling result from the shape of the light source 20 and the size and location of the RF slot openings 18 and the plurality of openings 22 of the primary reflector 16.

FIG. 3 shows velocity profiles of air flow across the length of the light source 20 of the prior art and the primary reflector 16 for different levels of air velocity. FIG. 4A shows velocity profiles of air flow normal to the light source 20 of the prior art in the vicinity of the RF slot openings 18 of the primary reflector 16. FIG. 4B shows velocity profiles of air flow normal to the light source 20 of the prior art in the vicinity of the smaller openings 22 of the primary reflector 16. FIG. 5A shows surface flow wrapping of air around the light source 20 of the prior art in the vicinity of the RF slot openings 18 of the primary reflector 16. FIG. 5B shows surface flow of air diverging near the side of the light source 20 of the prior art distal to the smaller openings 22 of the primary reflector 16. Referring now to FIGS. 3-5B, the flow of air differs along the length of the light source 20, with greater levels of air flow near the RF slot openings 18 and lower levels of air flow therebetween emanating from the plurality of openings 22. Thus, in the regions 40 of the light source 20 near the RF slot openings 18, the air flow pattern 42 envelopes the light source 20, thereby lowering the temperature of the light source 20 effectively. In other regions 44 of the light source 20 near the plurality of openings 22, the air flow pattern 46 bows out, wherein it flows across the light source 20 on the side 48 nearest the apex 40 of the primary reflector 16, but is absent on the side of 50 of the light source 20 distal to the apex 40 of the primary reflector 16, thereby causing a significant increase in temperature relative to the temperature of the light source 20 proximal to the RF slot openings 18 as depicted in FIGS. 6A-6C to be discussed hereinbelow.

FIG. 6A shows a top down view of a light source 20 of the prior art overlying a primary reflector 16 with gray scale shading along the light source 20 indicating relative temperature. FIG. 6B shows a perspective view of a light source 20 of the prior art and the primary reflector 16 of FIG. 6A with grey scale shading along the light source 20 indicating relative temperature, and direct indications of the temperature of the lamp proximal to the RF slot openings 18 of the primary reflector 16 and near the center of the light source 20. FIG. 6C is a plot of temperature versus distance along the light sources 20 of FIGS. 6A and 6B. Referring now to FIG. 6A-6C, the hottest spots 51 on the light source 20 are shifted slightly to the interior of the RF slot openings 18, and having a temperature of about 1012° C., represented by a lighter shade of grey. The coolest spots 52, 54, represented by deeper shades of grey, may be found in the immediate vicinity of the RF slot openings 18 and near the center of the light source 20, respectively. From FIGS. 3-6C, it would be tempting to increase the size of the plurality of openings 22 to increase airflow around the light source 20. However, a person skilled in the art would appreciate that this may result in an increase of UV radiation escaping though plurality of openings 22, thereby reducing the peak UV curing irradiance of the work product.

Accordingly, what would be desirable, but has not yet been provided, is a light source having lower cooling requirements and that provides increased peak UV curing irradiance.

SUMMARY OF THE INVENTION

The above-described problems are addressed and a technical solution is achieved in the art by providing elongated tubular light source having a substantially elliptical cross-section for use with the UV curing lamp assemblies. The light source has a pair of end sections and a central section of smaller diameter than the end sections. The end sections are connected to the central section by a pair of tapered sections the diameter of each of which decreases from an end that mates with the end sections toward an end that mates with the central section. Each of the end sections has a substantially elliptical cross-section. According to an embodiment of the present invention, the central section and the tapered sections may have a substatially elliptical cross-section.

According to an embodiment of the present invention, an aspect ratio of the elliptical cross-section of the end sections and the central section of the light source is preferably about 2:1. As a result, the elliptical cross-sectional shape of the light source of the present invention permits a reduction of air flow rate requirements and blower speed compared to the conventional light source of circular cross-section.

According to an embodiment of the present invention, the elliptical light source may be incorporated into an irradiator of a UV curing lamp assembly, which includes a primary reflector, having a generally smooth half-elliptical shape. In a preferred embodiment, the geometric center of the elliptical cross-section of the light source is placed at the internal focus of the half-ellipse formed by the primary reflector. The elliptical light source has a pair of short quartz stubs of substantially rectangular cross-section at either end to provide mechanical support for quick mounting into spring-loaded substantially rectangular receptacles located in the end reflectors. The stubs and the receptacles (holes) in the end reflector have a substantially rectangular shape and are keyed to fit in only one orientation to insure that the major axis of the ellipse of the cross-section of the light source is aligned with the major axis of the elliptical cross-section of the primary reflector.

As an added benefit, the elliptical shape of the light source improves the amount of irradiance a work piece receives.

BRIEF DESCRIPTION OF THE DRAWINGS

The present invention may be more readily understood from the detailed description of an exemplary embodiment presented below considered in conjunction with the attached drawings and in which like reference numerals refer to similar elements and in which.

It is to be understood that the attached drawings are for purposes of illustrating the concepts of the invention and may not be to scale.

DETAILED DESCRIPTION OF THE INVENTION

Figure 7:
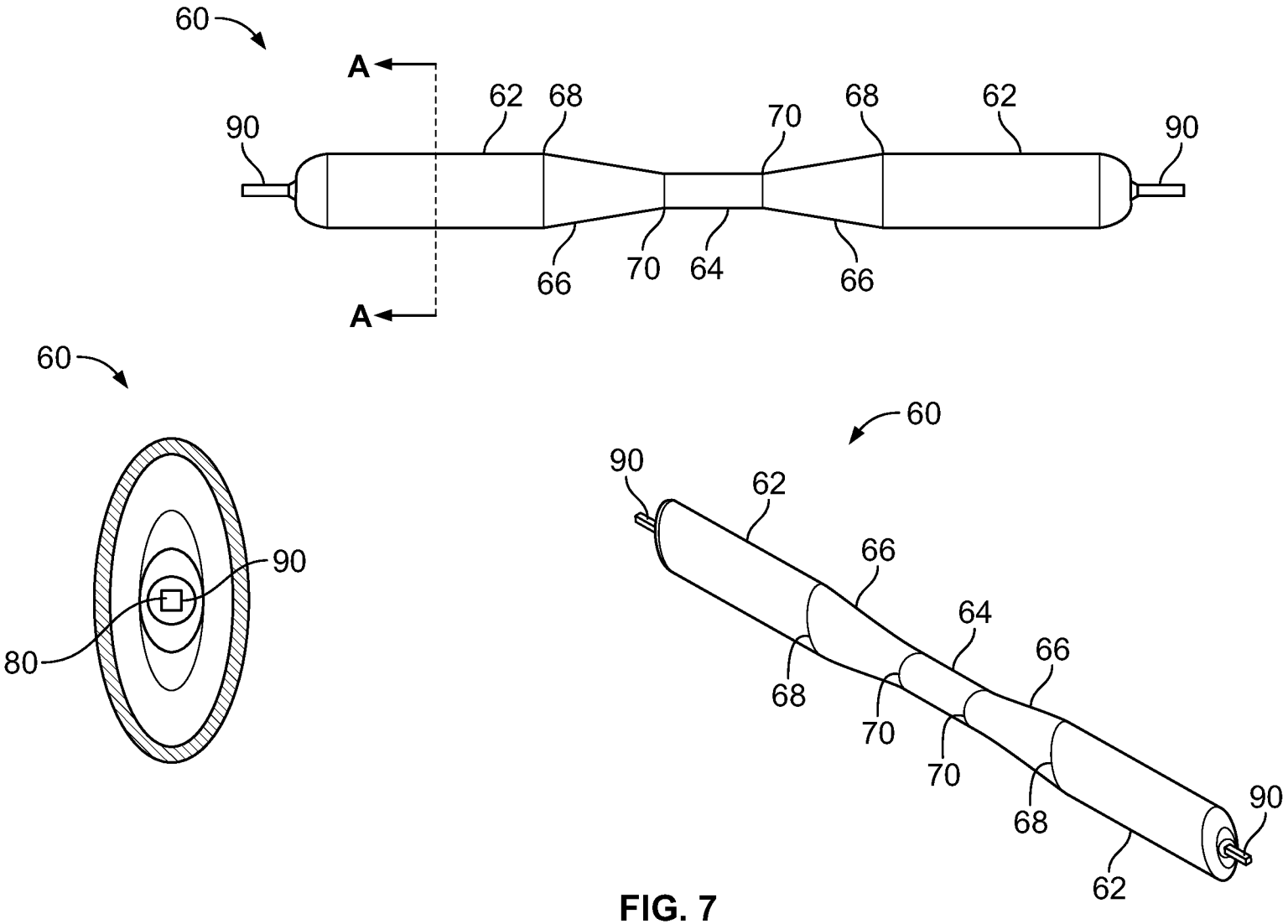
FIG. 7 shows a plurality of views of an elongated tubular light source having a substantially elliptical cross-section for use with UV curing lamp assemblies, according to an embodiment of the present invention.

FIG. 7 shows a plurality of views of an elongated tubular light source 60 having a substantially elliptical cross-section for use with UV curing lamp assemblies, according to an embodiment of the present invention. The light source 60 (e.g., an electrodeless bulb 60 or arc lamp 60) has a pair of end sections 62 and a central section 64 of smaller diameter than the end sections 62. The end sections 62 are connected to the central section 64 by a pair of tapered sections 66 the diameter of each of which decreases from an end 68 that mates with the end sections 62 toward an end 70 that mates with the central section 64. Each of the end sections 62 has a substantially elliptical cross-section. According to an embodiment of the present invention, the central section 64 and the tapered sections 66 may have a substantially elliptical cross-section. In certain other embodiments, the central section 64 may have a circular cross-section, the tapered sections 66 each having ends 68, 70 which have a cross-sections of a diameter that matches the diameter of the end sections 62 and the central section 64.

According to an embodiment of the present invention, the aspect ratio of the elliptical cross-section of the end sections 62 and the central section 64 of the light source 60 is preferably about 2:1 (i.e., the ratio of the length of the semi-major axis to the semi-minor axis of the ellipse), which permits complete wrap-around of air flow for cooling the light source 60. As a result, the elliptical cross-sectional shape of the light source 60 of the present invention permits a reduction of air flow rate requirements and blower speed compared to the conventional light source 20 of circular cross-section. Alternatively, rather than decreasing air flow rate and blower speed, the elliptical cross-sectional shape of the light source 60 of the present invention permits an increase in power applied to the light source 60. As a result, additional UV output power may be made available without requiring additional cooling.

Figure 1A:
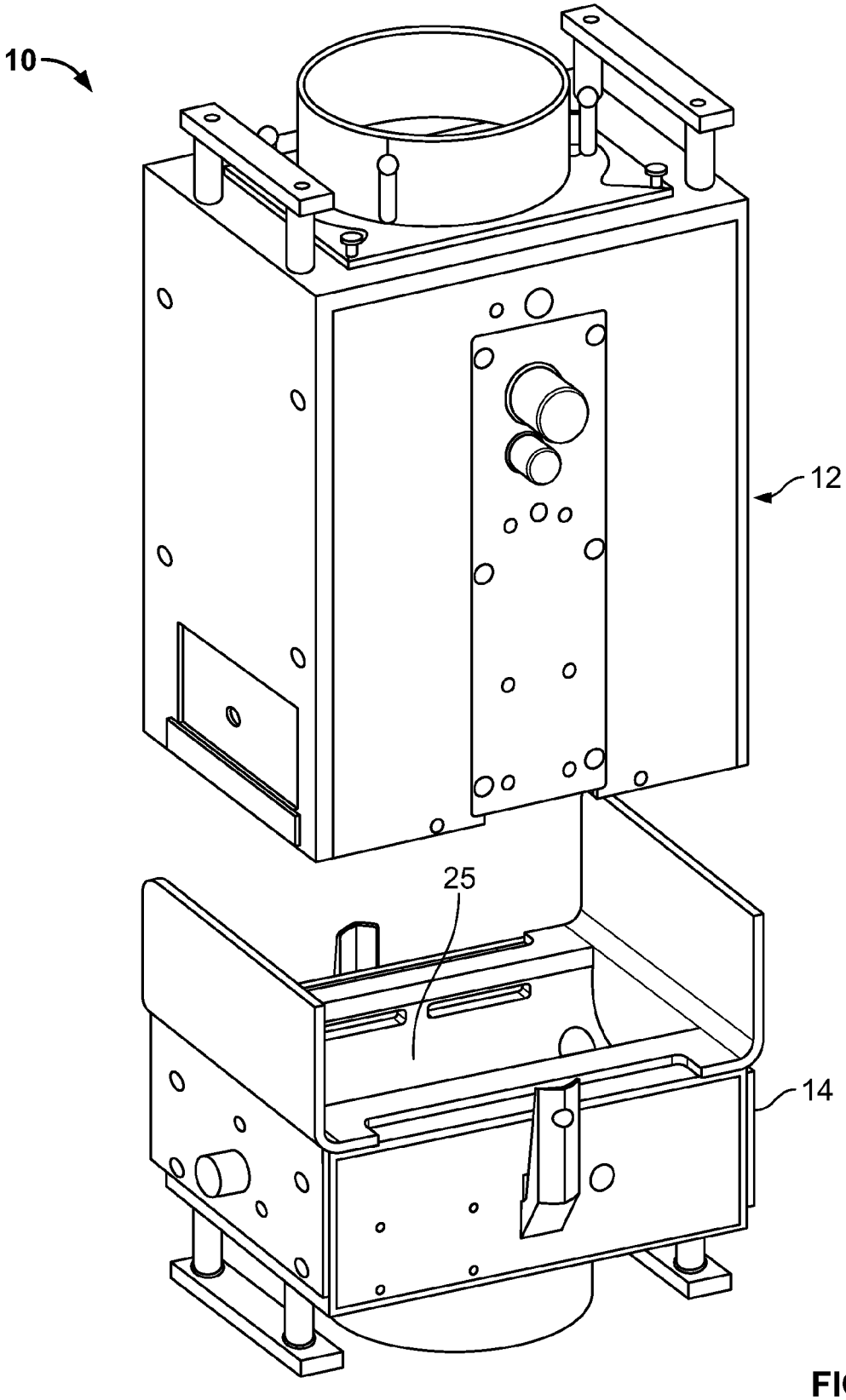
FIG. 1A (Prior Art)
FIG. 1A is a perspective view of a UV curing lamp assembly showing an irradiator and a light shield assembly in the prior art.
Figure 1B:
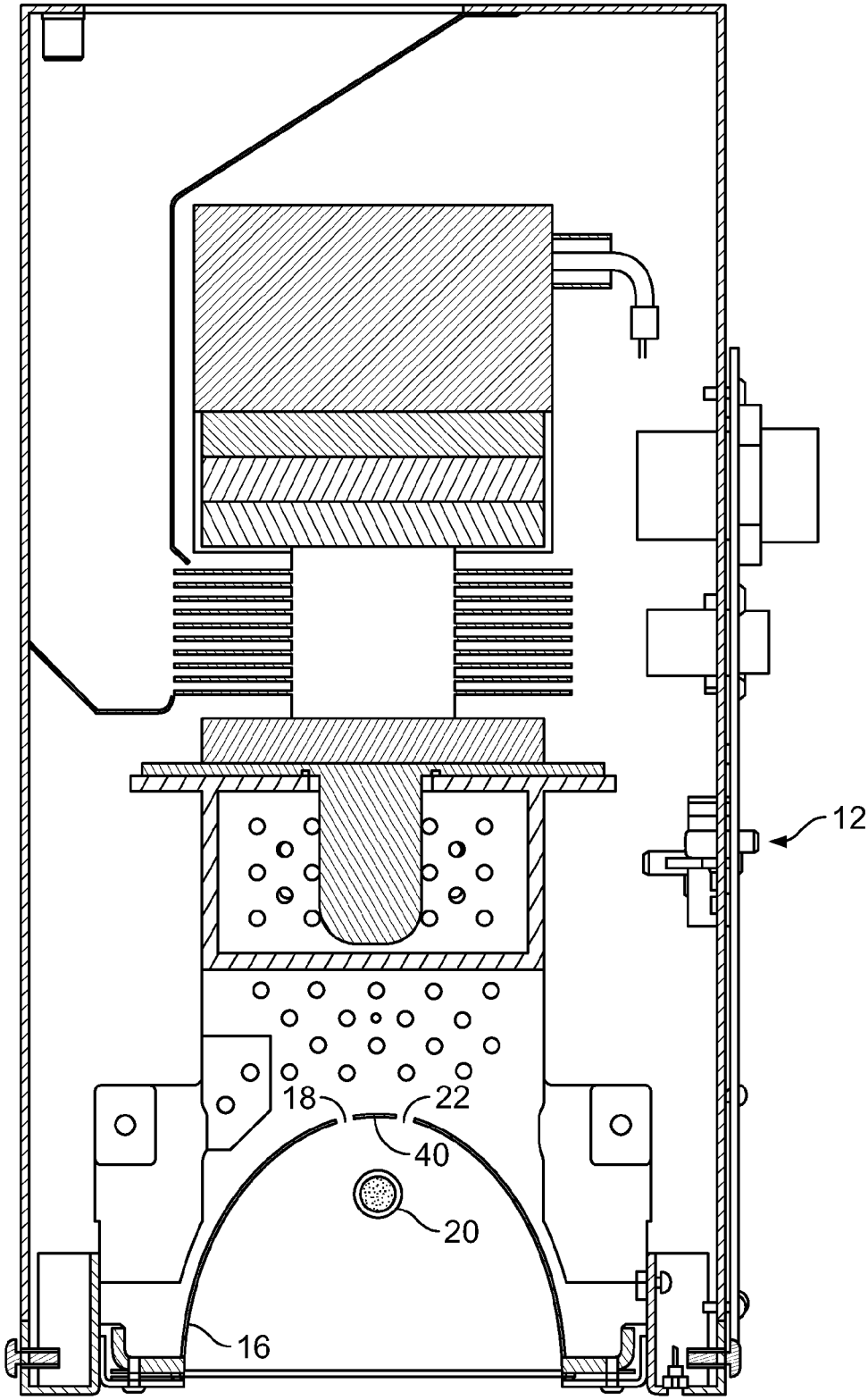
FIG. 1B (Prior Art)
FIG. 1B is a partial cross-sectional view of the lamp assembly of FIG. 1A showing a half-elliptical primary reflector and a light source of circular cross-section.
Figure 1C:
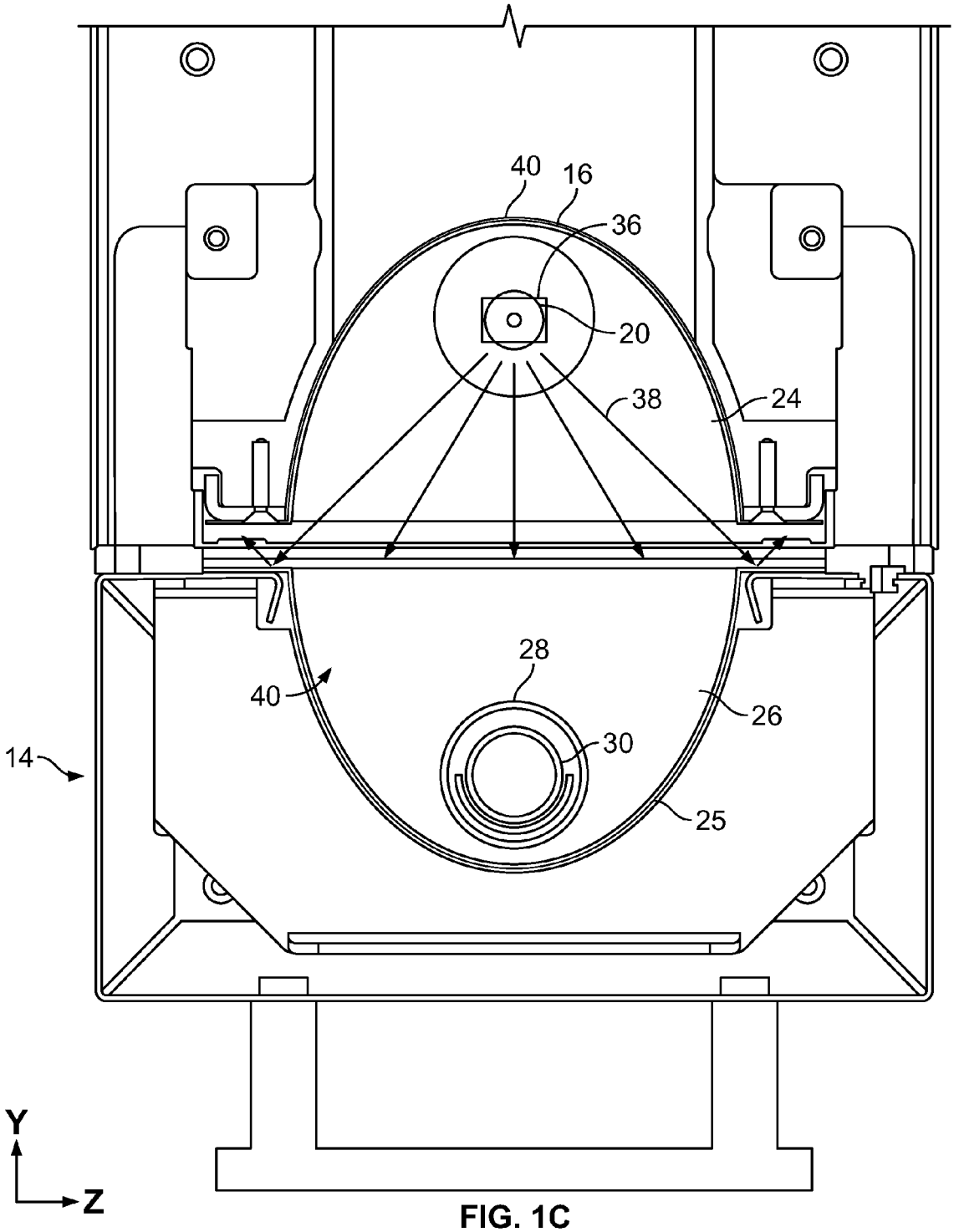
FIG. 1C (Prior Art)
FIG. 1C is a partial cross-sectional internal view of the lamp assembly interconnected with the light shield assembly of FIG. 1A, showing a half-elliptical primary reflector and a light source of circular cross-section mated to a secondary reflector and end reflectors.
Figure 2A:
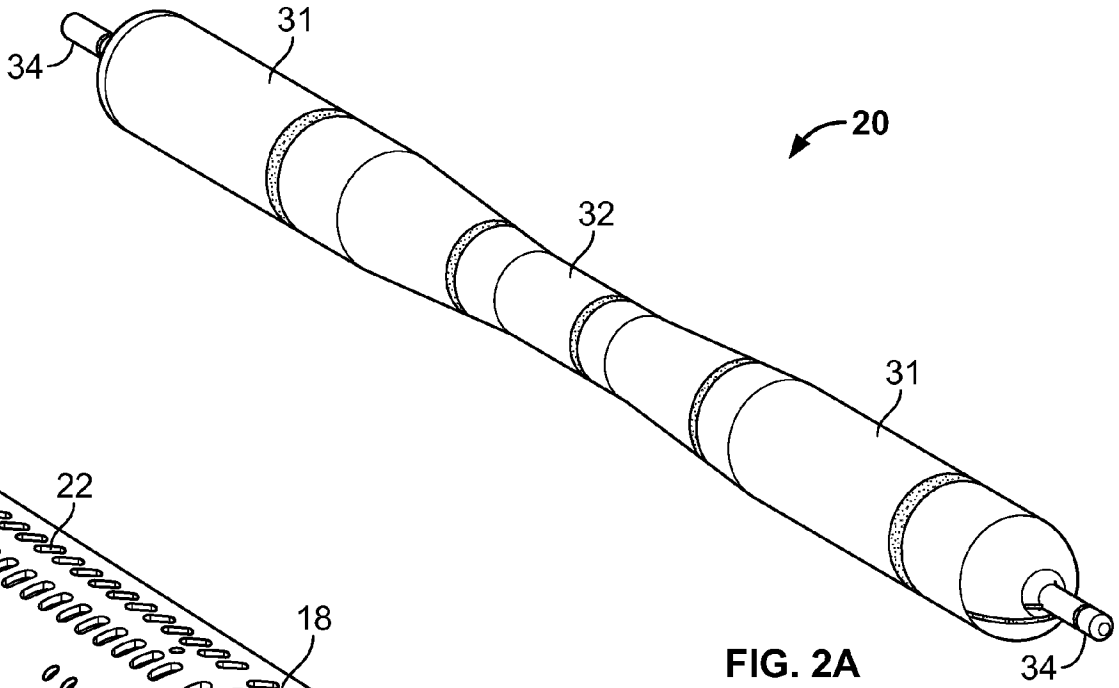
FIG. 2A (Prior Art)
FIG. 2A is a perspective view of a tubular light source having a generally circular cross-section in the prior art for use with the UV curing lamp assembly of FIG. 1A-1C.
Figure 2B:
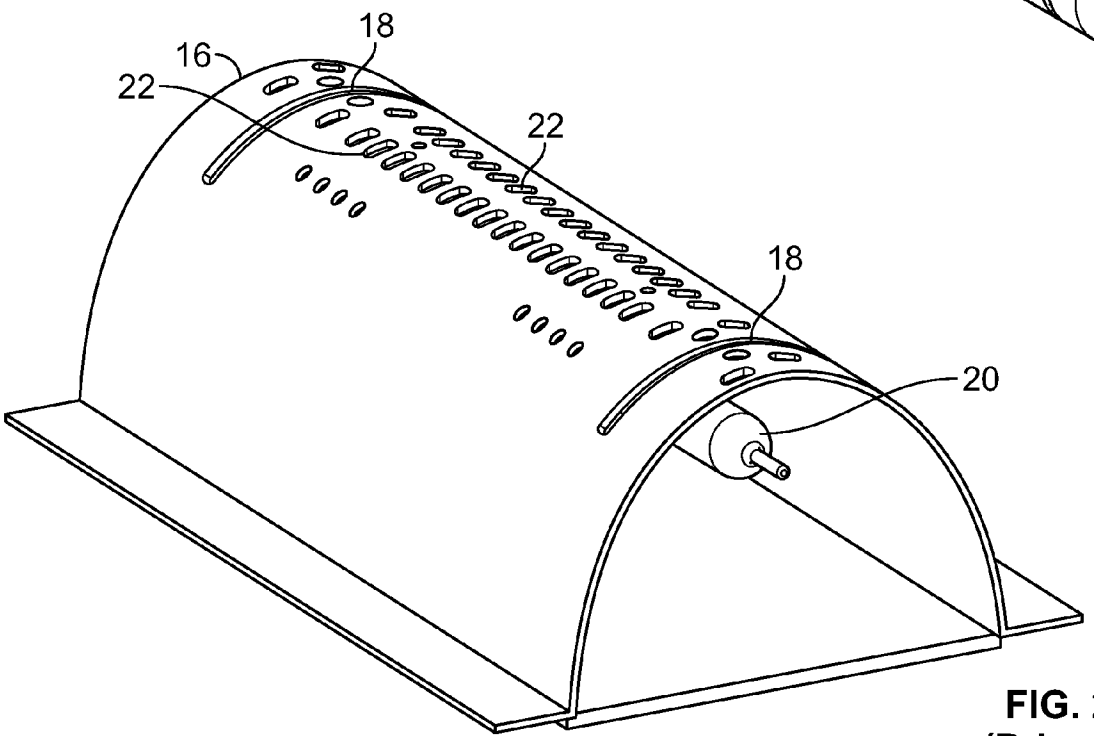
FIG. 2B (Prior Art)
FIG. 2B is a perspective view of a primary reflector with the tubular light source of FIG. 2A inserted therein, the primary reflector having openings for receiving microwave radiation to excite the light source and openings for receiving air flow to cool the light source for use with the UV curing lamp assembly of FIG. 1A-1C.
Figure 3:
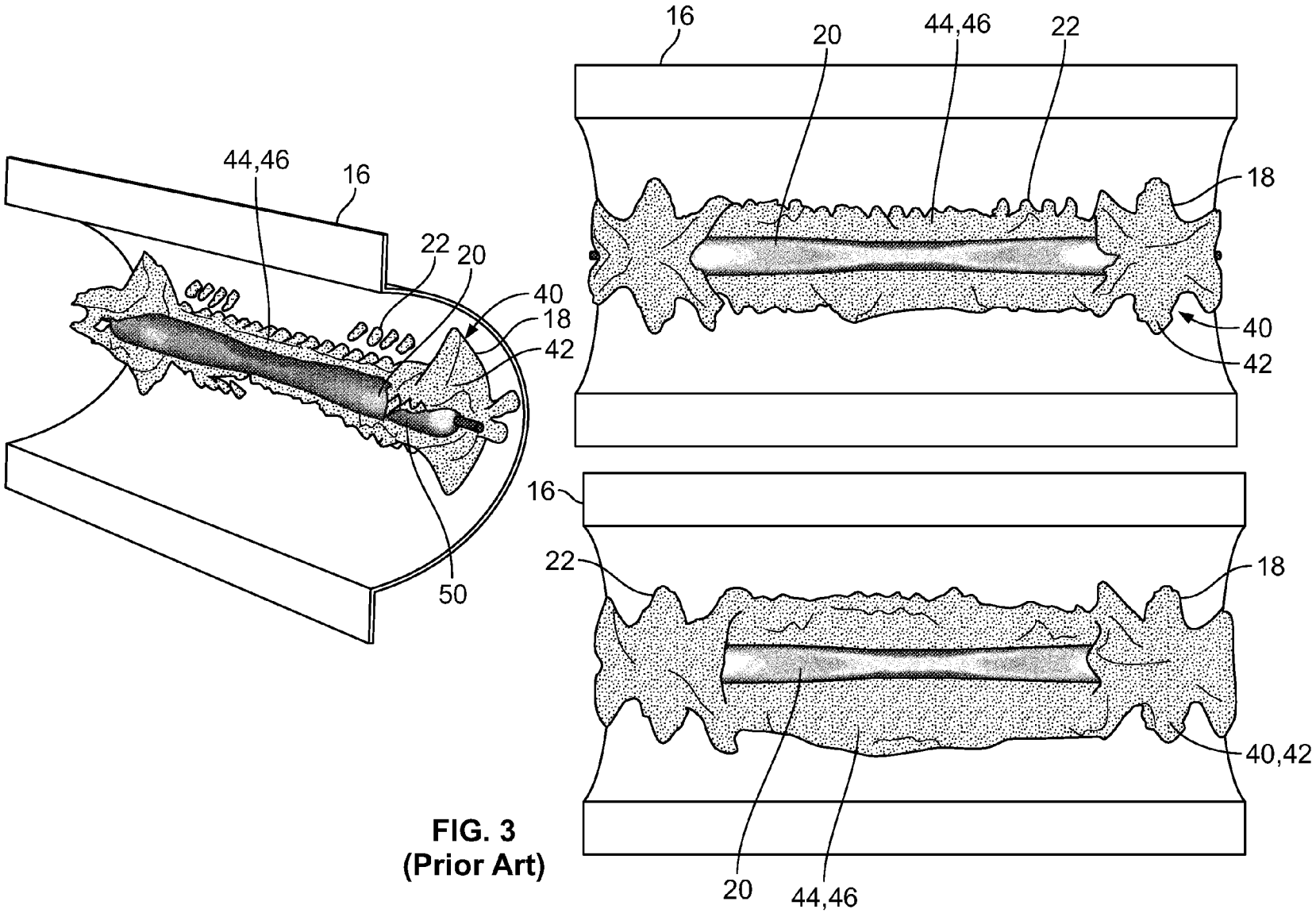
FIG. 3 (Prior Art)
FIG. 3 shows velocity profiles of air flow across the length of the light source of the prior art and the primary reflector for different levels of air velocity.
Figure 4A:
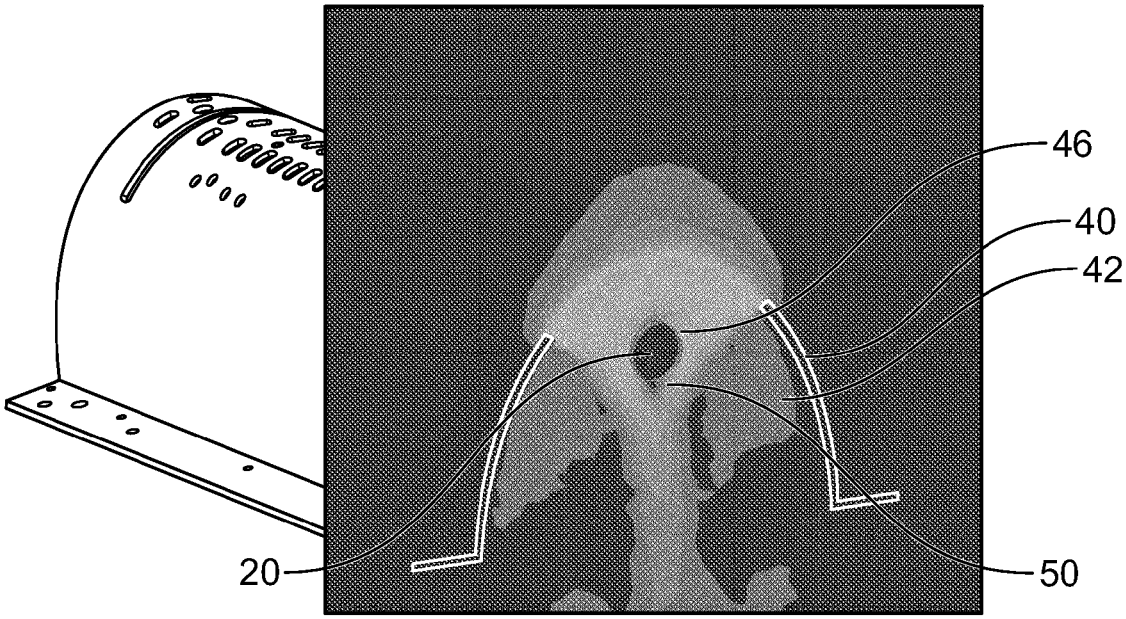
FIG. 4A (Prior Art)
FIG. 4A shows velocity profiles of air flow normal to the light source of the prior art in the vicinity of the RF slot openings of the primary reflector.
Figure 4B:
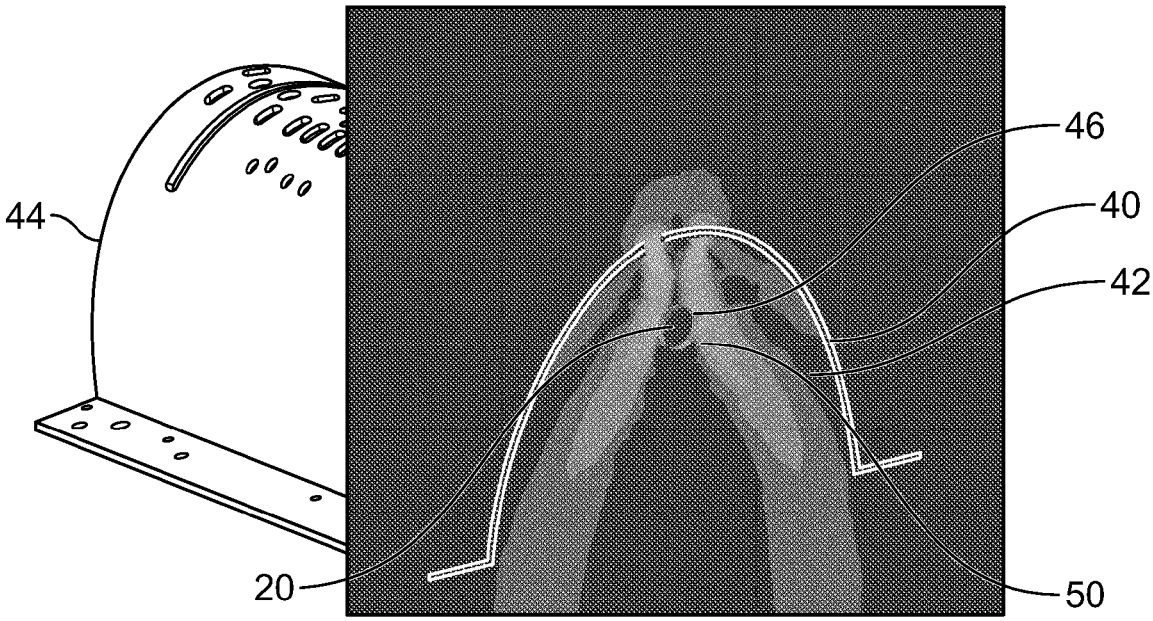
FIG. 4B (Prior Art)
FIG. 4B shows velocity profiles of air flow normal to the light source of the prior art in the vicinity of the smaller openings of the primary reflector.
Figure 5B:
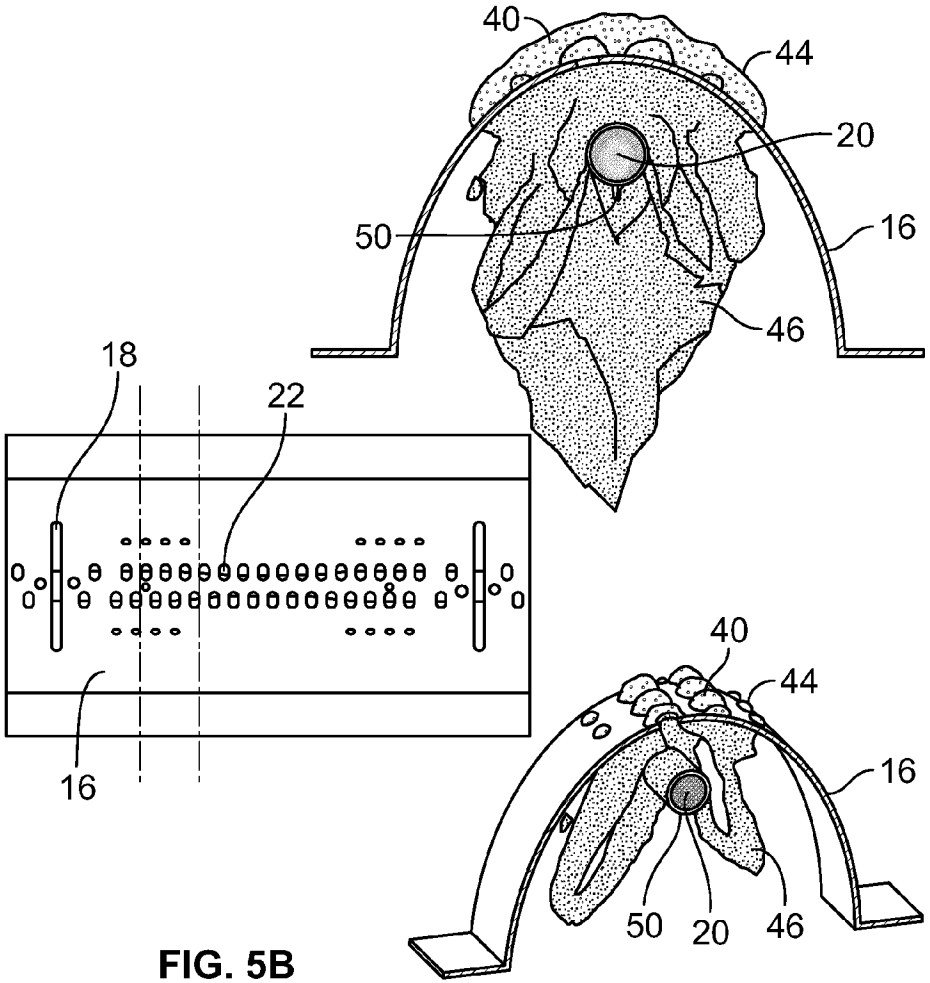
FIG. 5B (Prior Art)
FIG. 5B shows surface flow of air diverging near the side of the light source of the prior art distal to the smaller openings of the primary reflector.
Figure 5A:
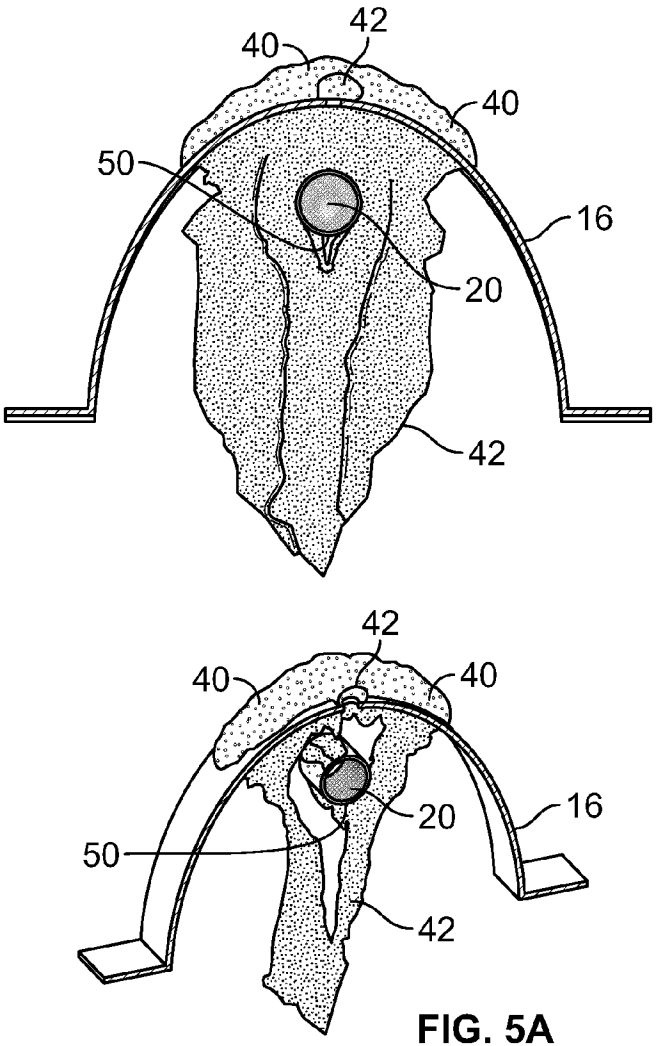
FIG. 5A (Prior Art)
FIG. 5A shows surface flow wrapping of air around the light source of the prior art in the vicinity of the RF slot openings of the primary reflector.
Figure 8:
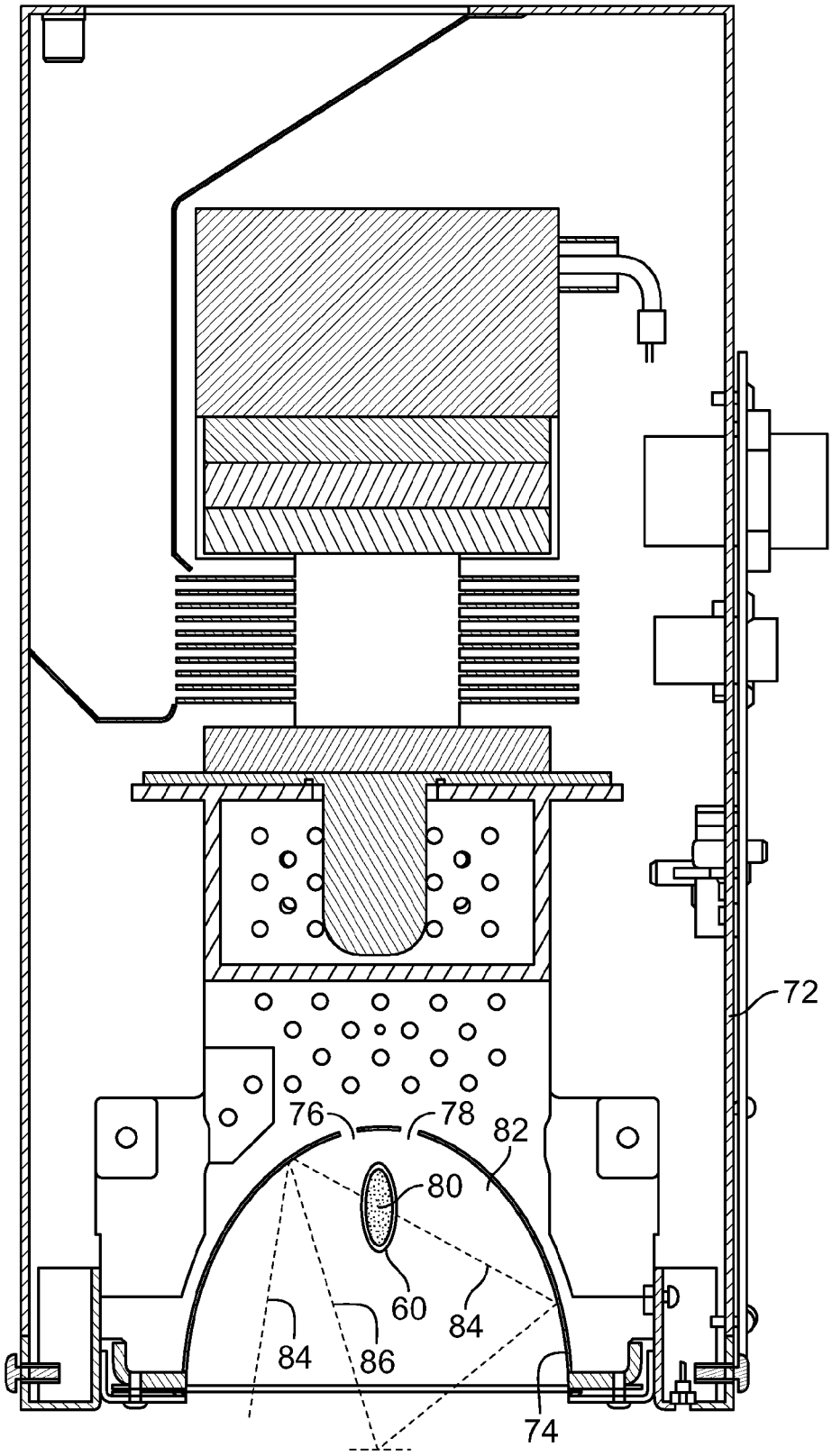
FIG. 8 shows a cross-sectional view of an irradiator assembly employing the light source of FIG. 7, according to an embodiment of the present invention.

FIG. 8 shows a cross-sectional view of an irradiator assembly employing the light source 60 of FIG. 7, according to an embodiment of the present invention. Referring now to FIGS. 7 and 8, according to an embodiment of the present invention, the light source 60 may be incorporated into an irradiator 72, similar to the one described in FIGS. 1A-1C, which includes a primary reflector 74, having a generally smooth half-elliptical shape studded with a pair of RF slot openings 76 for receiving microwave radiation to excite the light source 60, and smaller openings 78 for receiving air flow to cool the light source 60, respectively. The light source 60 includes the lamp 60 of FIG. 7 described above (e.g., a modular lamp, such as a microwave-powered lamp having a microwave-powered bulb (e.g., tubular bulb with a generally circular cross-section) with no electrodes or glass-to-metal seals). According to an embodiment of the present invention, the geometric center 80 of the elliptical cross-section of the light source 60 is preferably placed at the internal focus of the half-ellipse formed by the primary reflector 70. The light source 60 and the primary reflector 70 extend linearly along an axis in a direction moving out of the page (not shown). A pair of end reflectors 82 (one shown) terminate opposing sides of the primary reflector 70 to form a substantially half-elliptical reflective cylinder.

In operation, gas in the light source 60 is excited to a plasma state by a source of radio frequency (RF) radiation, such as a magnetron (not shown) located in the irradiator 72. The atoms of the excited gas in the light source 60 return to a lower energy state, thereby emitting ultraviolet light (UV). Ultraviolet light rays 84 radiate from the light source 60 in all directions, striking at least the inner surfaces of the primary reflector 70 and the end reflectors 82. Most of the ultraviolet light rays 84 are reflected toward the central axis of a work product 86. The light source 60 and reflector design are optimized to produce the maximum peak light intensity (lamp irradiance) at the surface of a work product 86 (also propagating linearly out of the page.

Figure 9:
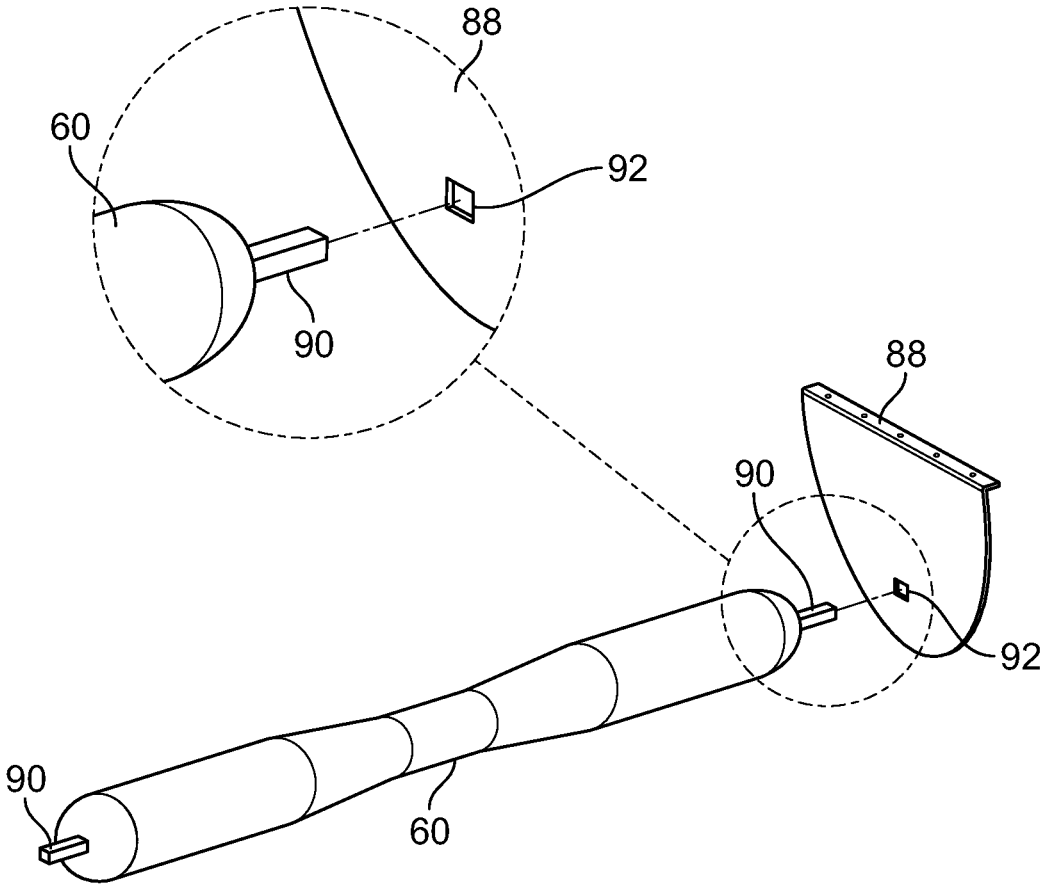
FIG. 9 shows a perspective view of an end reflector having rectangular openings for receiving the rectangular stubs of the light source of FIG. 7 for use in the irradiator assembly of FIG. 8, according to an embodiment of the present invention.
Figure 10A:
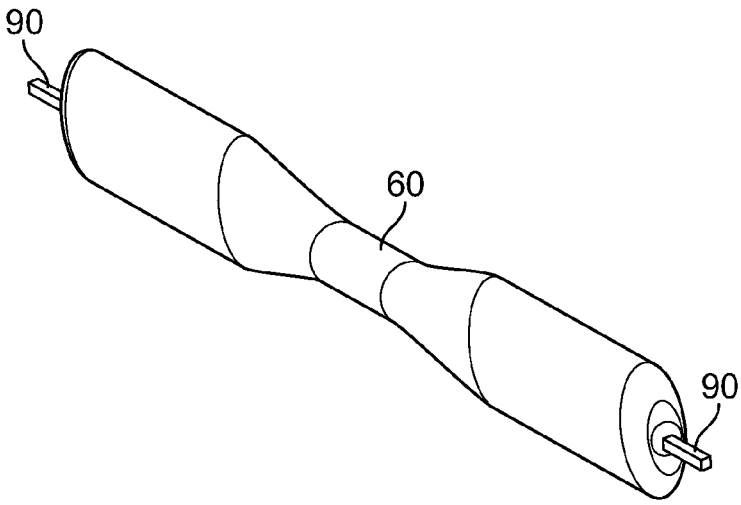
FIGS. 10A and 10B are perspective views of a half-elliptical primary reflector and a light source of elliptical cross-section, according to an embodiment of the present invention.
Figure 10B:
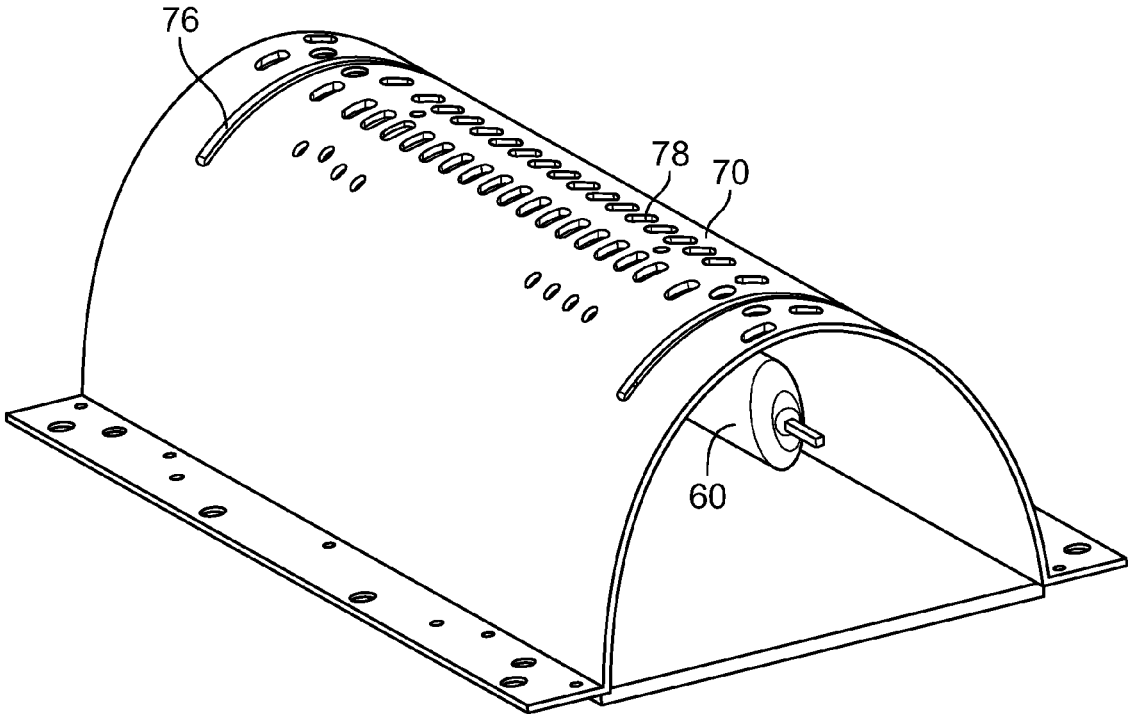

FIG. 9 shows a perspective view of an end reflector 88 having rectangular openings for receiving rectangular stubs of the light source of FIG. 7 for use in the irradiator assembly of FIG. 8, according to an embodiment of the present invention. FIGS. 10A and 10B are perspective views of a half-elliptical primary reflector and a light source of elliptical cross-section, according to an embodiment of the present invention. Referring now to FIGS. 7-10B, the light source 60 has a pair of short quartz stubs 90 of substantially rectangular cross-section at either end to provide mechanical support for quick mounting into spring-loaded substantially rectangular receptacles 92 located in the end reflectors 88. These stubs 90 are not electrodes and have no electrical function. Arc lamps are energized through electrodes at each end.

With light source 60 having a substantially elliptical cross-section, the orientation of the ellipse becomes paramount. The stubs 90 and the receptacles (holes) 92 in the end reflector 88 have a substantially rectangular shape and are keyed to fit in only one orientation. This insures that the major axis of the ellipse of the cross-section of the light source 60 is aligned with the major axis of the elliptical cross-section of the primary reflector 70.

Figure 11A:
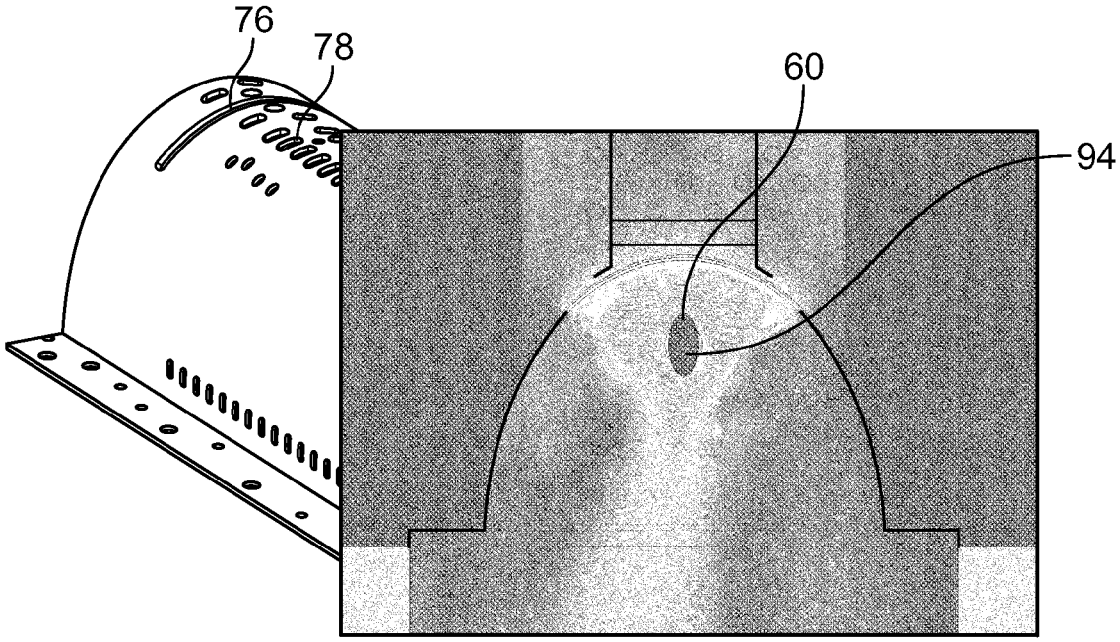
FIG. 11A shows surface flow wrapping air around the light source of the present invention in the vicinity of the RF slot openings of the primary reflector of FIG. 10B according to an embodiment of the present invention.
Figure 11B:
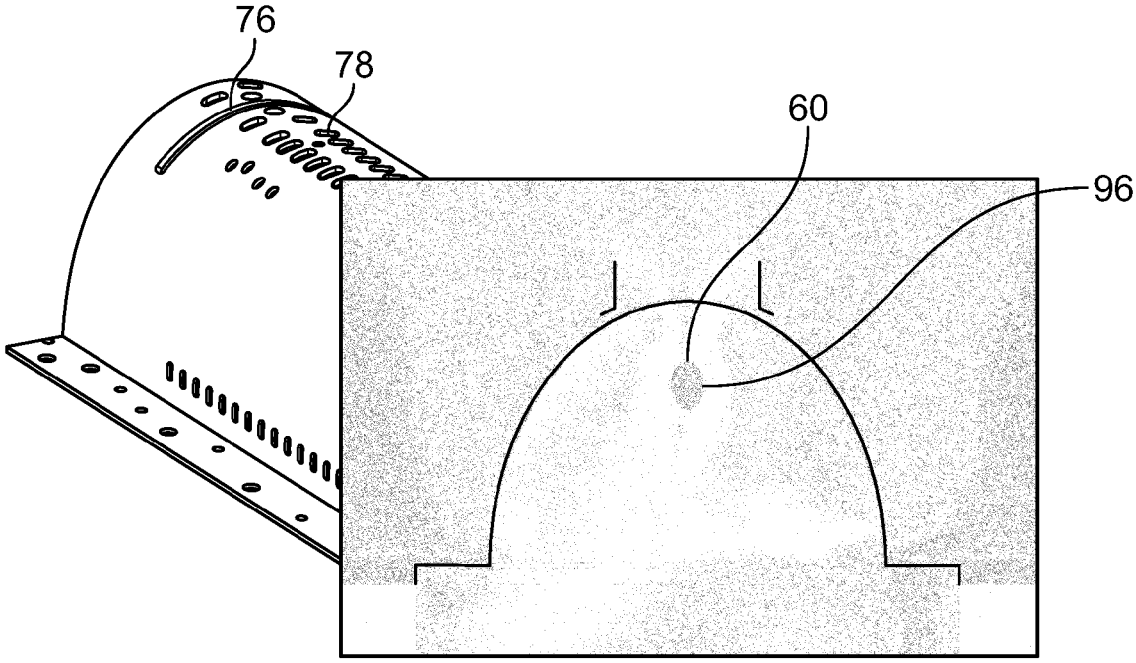
FIG. 11B shows surface flow wrapping air around the light source of the present invention in the vicinity of the smaller openings of the primary reflector of FIG. 10B according to an embodiment of the present invention.

FIG. 11A shows surface flow wrapping air around the light source of the present invention in the vicinity of the RF slot openings of the primary reflector of FIG. 10B, according to an embodiment of the present invention. FIG. 11B shows surface flow wrapping air around the light source of the present invention in the vicinity of the smaller openings of the primary reflector of FIG. 10B, according to an embodiment of the present invention. Referring now to FIGS. 11A and 11B, the flow of air differs along the length of the light source 60, with greater levels of air flow near the RF slot openings 76 and lower levels of air flow therebetween emanating from the plurality of smaller openings 78. Unlike the air flow pattern for the light source 20, the air flow pattern for the light source 60 completely envelopes the light source 60 in both the regions 94, 96 of the light source 60 near the RF slot openings RF slot openings 76 and the smaller openings 78, respectively.

Figure 6A:
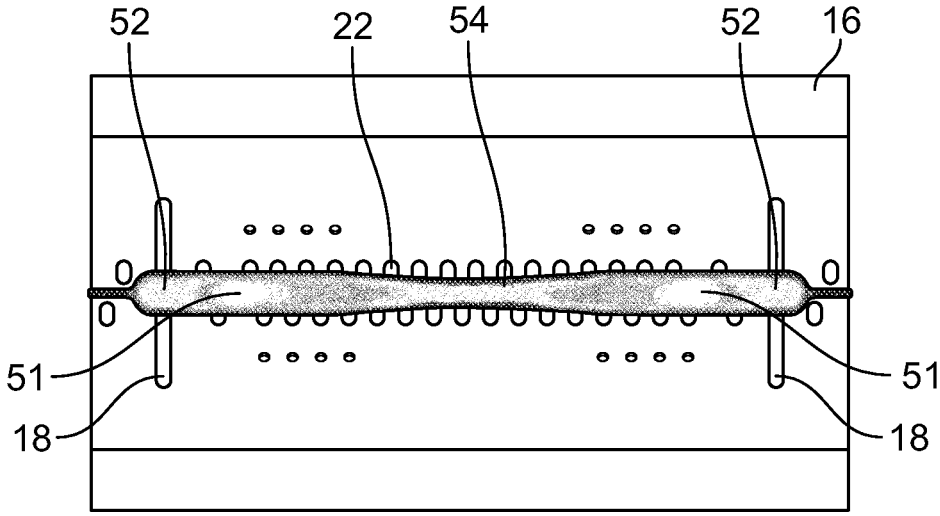
FIG. 6A (Prior Art)
FIG. 6A shows a top down view of a light source of the prior art overlying a primary reflector with grey scale shading along the light source indicating relative temperature.
Figure 6B:
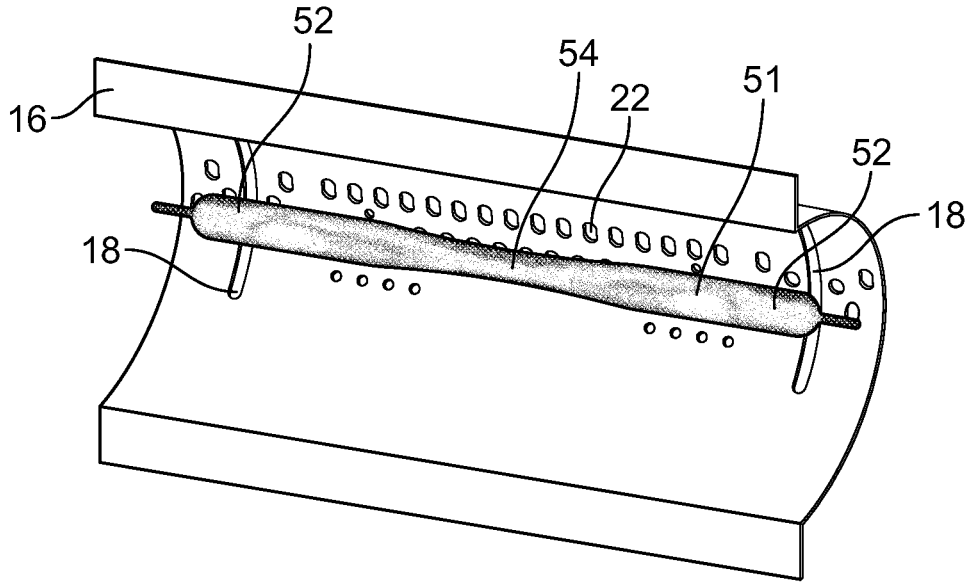
FIG. 6B (Prior Art)
FIG. 6B shows a perspective view of an light source of the prior art and the primary reflector of FIG. 6A with grey scale shading along the light source indicating relative temperature, and direct indications of the temperature of the lamp proximal to the RF slot openings of the primary reflector and near the center of the light source.
Figure 6C:
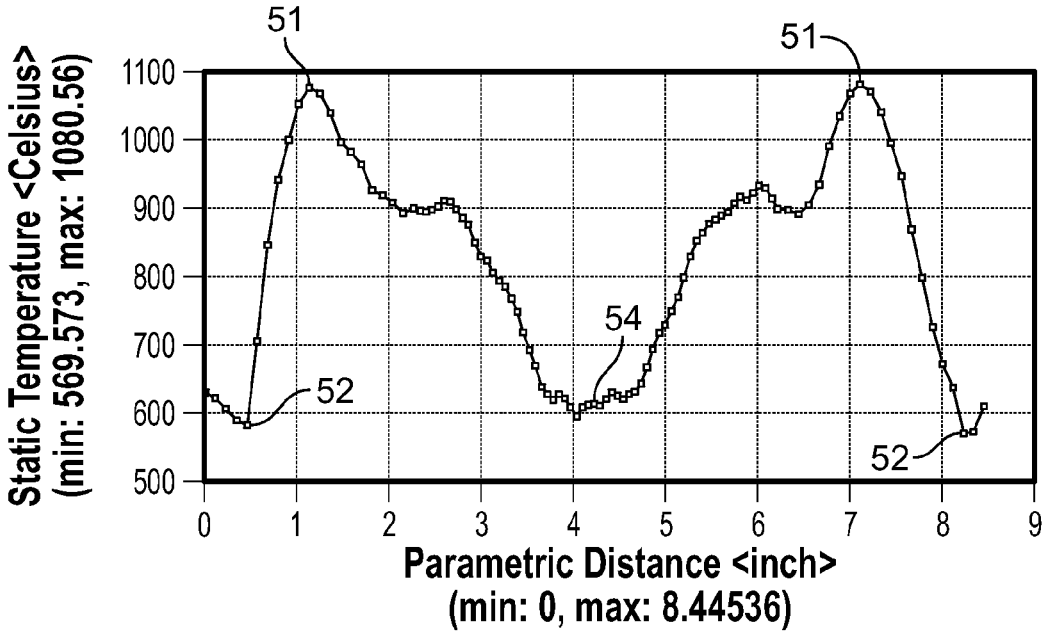
FIG. 6C (Prior Art)
FIG. 6C is a plot of temperature versus distance along the light sources of FIGS. 6A and 6B.
Figure 12A:
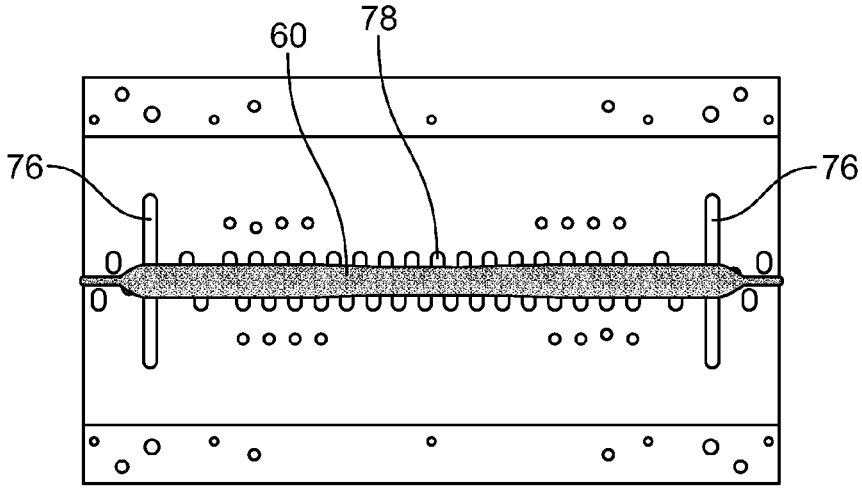
FIG. 12A shows a top down view of a light source of the present invention overlying a primary reflector of the type illustrated in FIG. 10B.
Figure 12B:
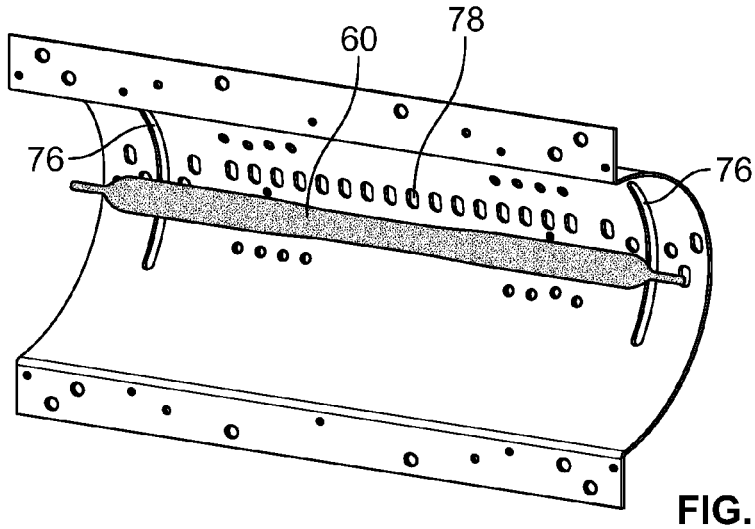
FIG. 12B shows a perspective view of an light source of the present invention and the primary reflector of FIG. 10B.
Figure 12C:
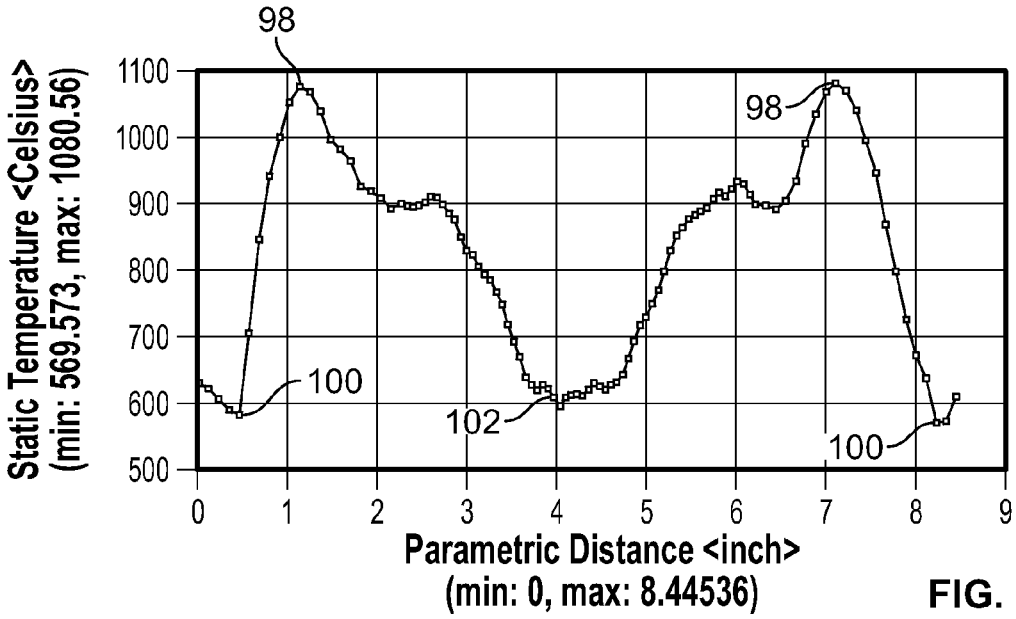
FIG. 12C is a plot of temperature versus distance along the light sources of FIGS. 12A and 12B.

FIG. 12A shows a top down view of the light source 60 of the present invention overlying a primary reflector of the type illustrated in FIG. 10B. FIG. 12B shows a perspective view of a light source of the present invention and the primary reflector 70 of FIG. 10B. FIG. 12C is a plot of temperature versus distance along the light sources 60 of FIGS. 12A and 12B. Referring now to FIGS. 12A-12C, the hottest spots 98 on the light source 60 are shifted slightly to the interior of the RF slot openings 76 and of a lower temperature than the hottest spots 51 on the light source 20 of FIGS. 6A-6C, for the same input flow rate. Likewise, the coolest spots 100, 102, represented by deeper shades of grey, may be found in the immediate vicinity of the RF slot openings 76 and near the center of the light source 60 and of a lower temperature than the coolest spots 52, 54 in the immediate vicinity of the RF slot openings 18 and near the center of the light source 20 of FIGS. 6A-6C, respectively.

Figure 13B:
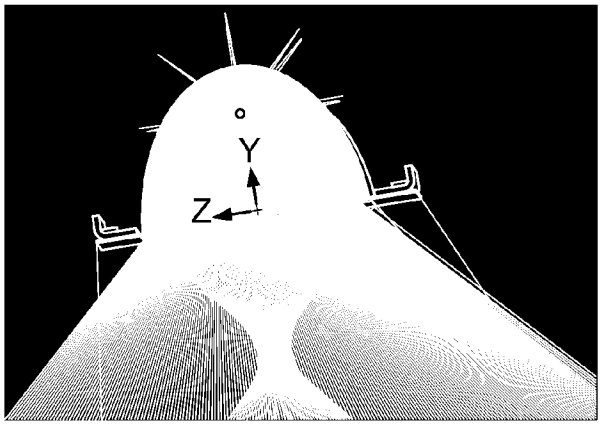
FIGS. 13A and 13B depict optical ray trace models of UV radiation emanating from a primary reflector of elliptical cross-section and illuminating an area corresponding to a work piece for a light source of circular cross-section and a light source of elliptical cross-section, respectively.
Figure 13A:
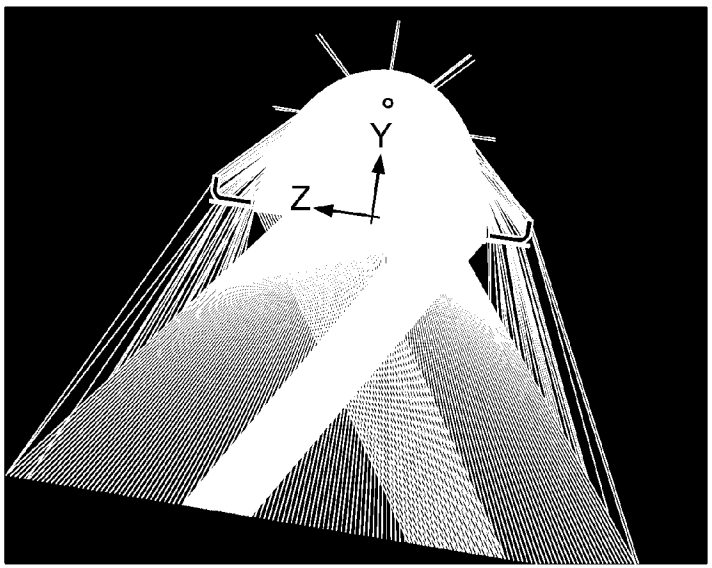
Figure 13A:
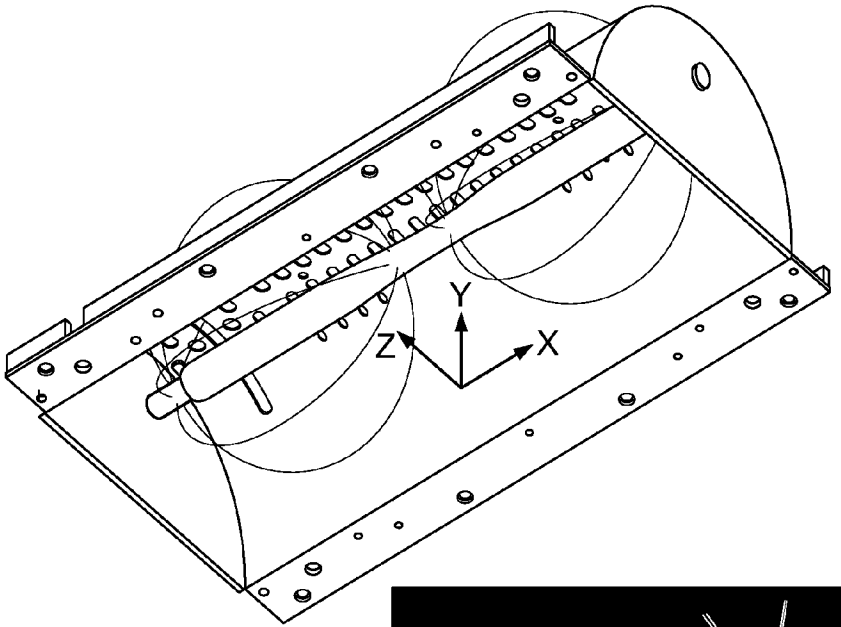

Certain embodiments of the present invention have enhanced optical properties as compared to the light source 20 of the prior art. FIGS. 13A and 13B depict optical ray trace models of UV radiation emanating from a primary reflector of elliptical cross-section and illuminating an area corresponding to a work piece for a light source of circular cross-section and a light source of elliptical cross-section, respectively. Referring now to FIGS. 8, 13A and 13B, optical ray trace modeling shows that when an elliptically-shaped bulb is employed and mounted in the orientation described in FIG. 8 and shown in FIG. 13B, less of the UV energy from the apex of the primary reflector 70 is blocked by the light source 60 because the cross-section of the light source 60 is reduced compared to that of the conventional tubular light source 20 of circular cross-section as depicted in FIG. 13A. In FIG. 13A, the rays of UV radiation come to a peak at a certain distance from the primary reflector, but a significant portion of the UV radiation is spread over a relatively wide area. In FIG. 13B, the resulting peak of the ray traces come to a more defined position in front of the primary reflector, with considerably less of the UV radiation spreading beyond the peak position.

Figure 14A:
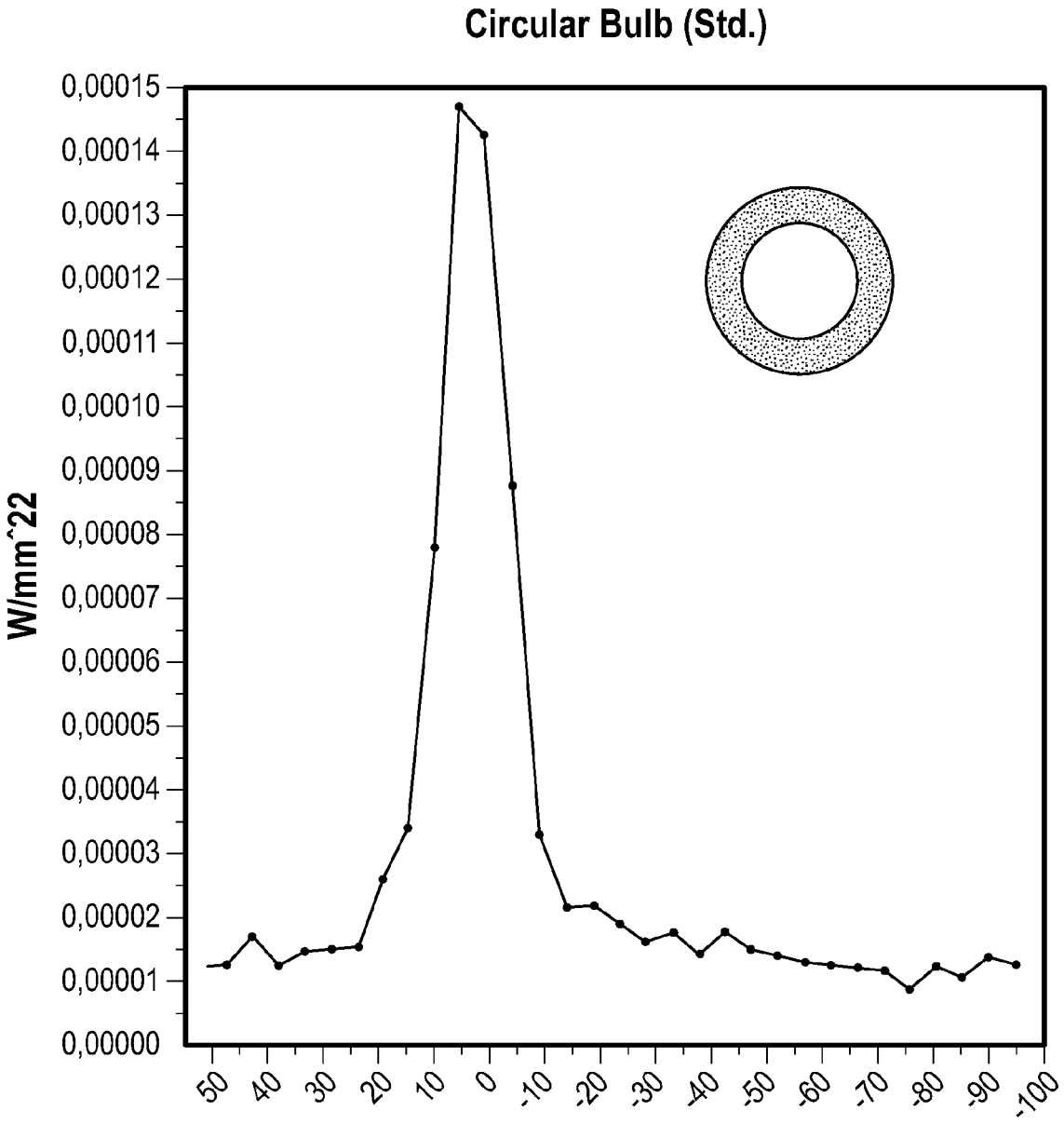
FIGS. 14A-14C show plots of distance along an illuminated surface versus irradiance for light sources of different cross-sections, from circular, wide elliptical, and true elliptical cross-section, respectively.
Figure 14B:
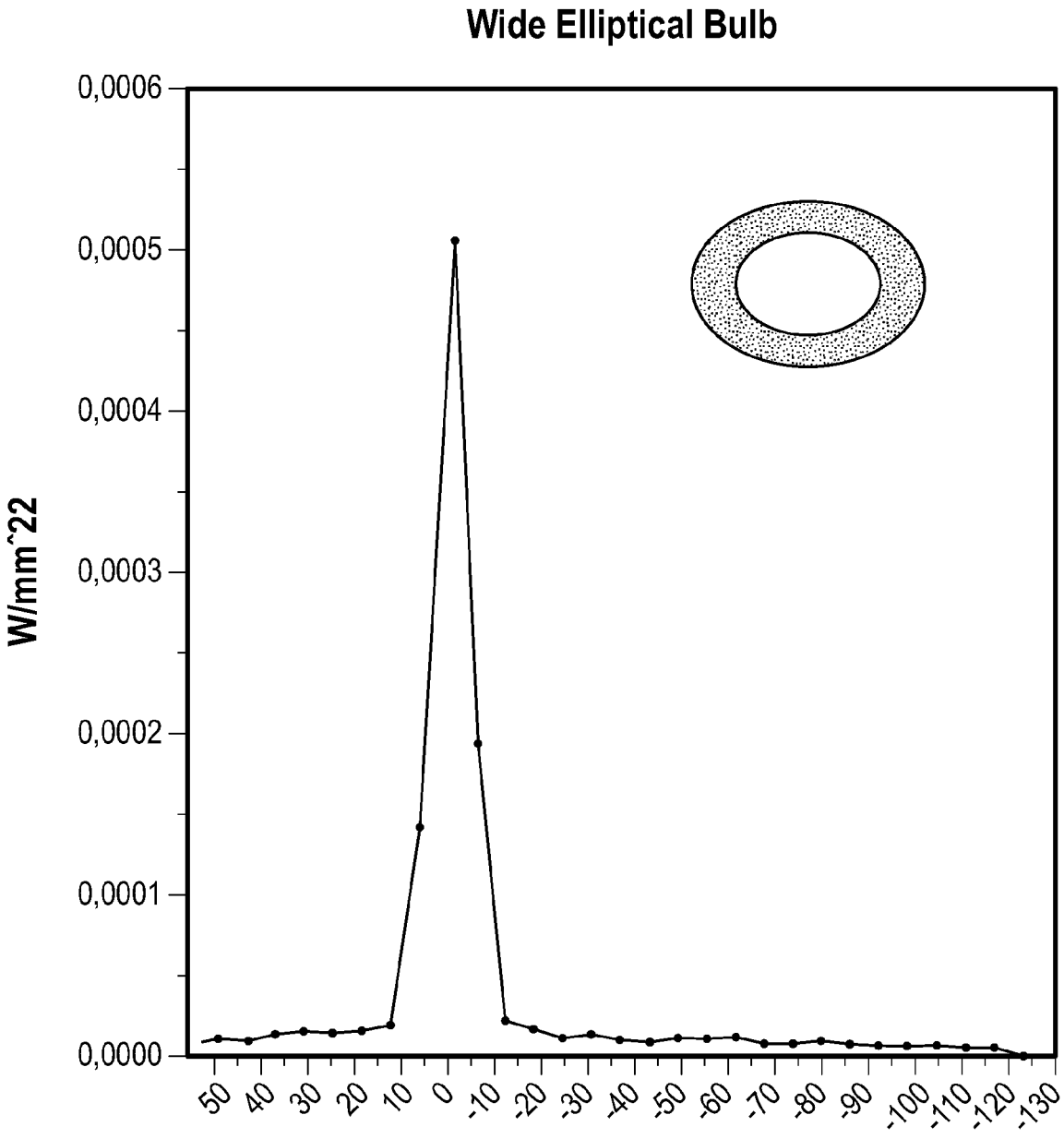
Figure 14C:
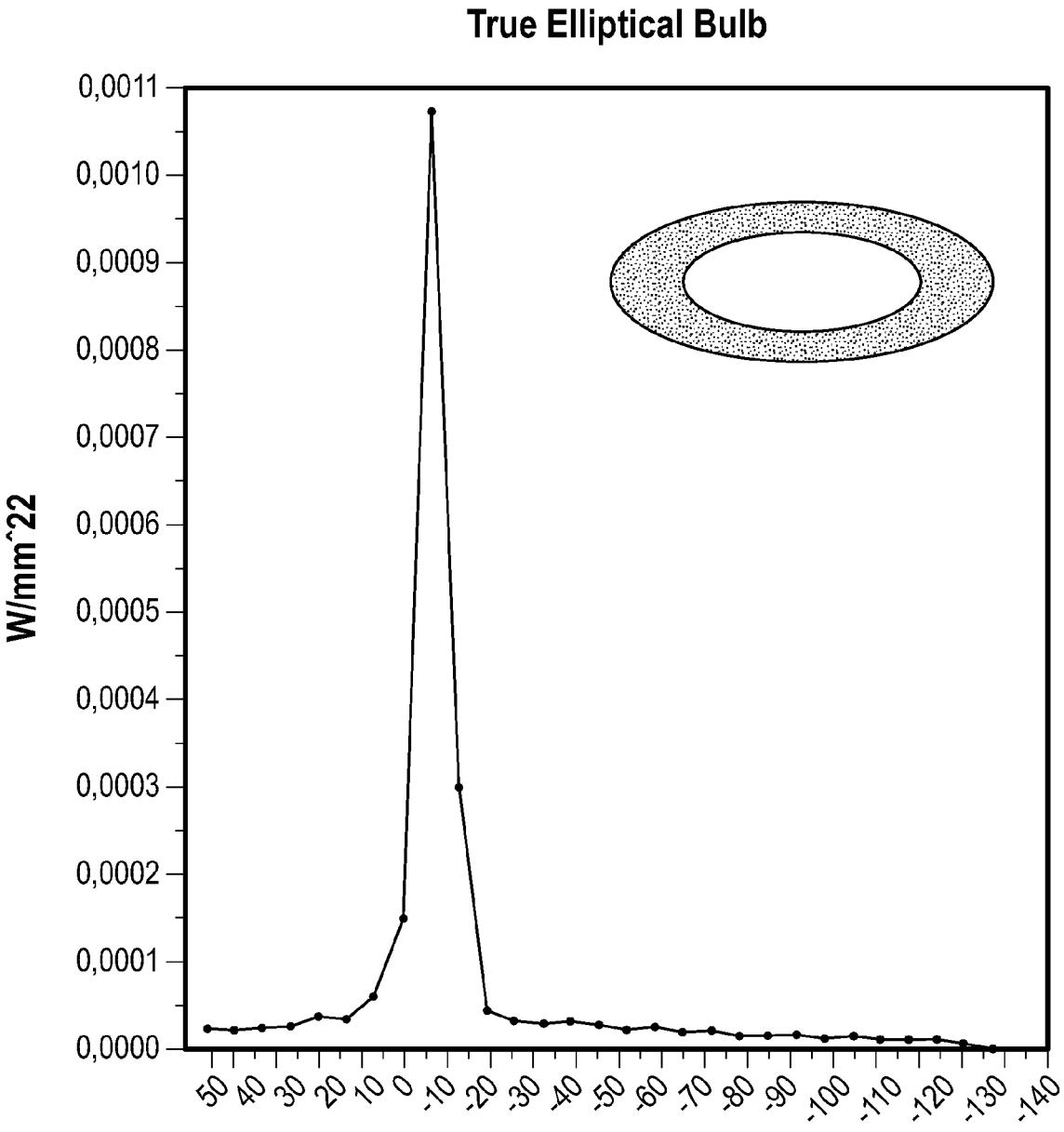

FIGS. 14A-14C show plots of distance along an illuminated surface versus irradiance for light sources of different cross-sections, from circular, wide elliptical, and true elliptical cross-section, respectively. For a light source of circular cross-section in FIG. 14A, the irradiance shows a peak that is spread over a relatively wide range of distance along an illuminated surface. There is also a considerable amount of light spread over the length of the illuminated surface for regions of the illuminated surface that are not in the vicinity of the peak irradiance. The peak irradiance of a wide elliptical light source (i.e., one having an aspect ration is much less than 2:1) in FIG. 14B is considerably sharper (i.e., spread over a shorter distance along an illuminated surface) than that of FIG. 14A, but of lower magnitude. There is a much lower magnitude of irradiance in regions not in the vicinity of the peak irradiance. The peak irradiance of a true elliptical light source (i.e., one having an aspect ration of about 2:1 or greater) in FIG. 14C has both a sharper focus (i.e., spread over a shorter distance along an illuminated surface) and a considerably greater magnitude than either of the light source of FIGS. 14A and 14B, while maintaining a low magnitude of irradiance in regions not in the vicinity of the peak irradiance.

It is to be understood that the exemplary embodiments are merely illustrative of the invention and that many variations of the above-described embodiments may be devised by one skilled in the art without departing from the scope of the invention. It is therefore intended that all such variations be included within the scope of the following claims and their equivalents.

What is claimed is:

1. An elongated tubular light source envelope composed of fused quartz or fused silica comprising a pair of end sections and a central section of smaller diameter than the pair of end sections, each of the pair of end sections connected to the central section by a tapered section, each of the pair of end sections having a substantially elliptical cross-section in a plane perpendicular to a longitudinal axis and the central section having a substantially circular cross-section.

2. The light source envelope of claim 1, wherein the diameter of each tapered section decreasing from an end that mates with an end section toward an end that mates with the central section.

3. The source envelope of claim 1, wherein an aspect ratio of the elliptical cross-section of the end sections to the central section of the light source envelope is about 2:1.

4. The light source envelope of claim 1, wherein each tapered section has a cross-section that transitions from substantially elliptical at a junction with a corresponding end section to substantially circular at a junction with a corresponding end of the central section.

5. The light source envelope of claim 1, wherein a closed portion of an end section comprises an elongated stub of substantially rectangular cross-section extending therefrom to provide mechanical support.

6. The light source envelope of claim 5, wherein the stub has a substantially rectangular shape and is keyed to fit in only one orientation of a primary reflector.

7. An ultraviolet (UV) curing lamp assembly comprising:

an elongated primary reflector having a substantially smooth half-elliptical cross-section and a pair of ends;

a pair of end reflectors each of which is mounted to a corresponding end of the primary reflector to form a portion of a substantially half-elliptical irradiator; and an elongated tubular light source envelope composed of fused quartz or fused silica mounted to each end reflector, the elongated tubular light source envelope comprising a pair of end sections and a central section of smaller diameter than the pair of end sections, each of the pair of end sections connected to the central section by a tapered section, each of the pair of end sections having a substantially elliptical cross-section in a plane perpendicular to a longitudinal axis and the central section having a substantially circular cross-section.

8. The UV curing lamp assembly of claim 7, wherein a geometric center of the elliptical cross-section of the light source is placed at an internal focus of the half-ellipse formed by the primary reflector.

9. The UV curing lamp assembly of claim 7, wherein the diameter of each tapered section decreasing from an end that mates with an end section toward an end that mates with the central section.

10. The UV curing lamp assembly of claim 7, wherein an aspect ratio of the elliptical cross-section of the end sections of the light source envelope to the central section of the light source envelope is about 2:1.

11. The UV curing lamp assembly of claim 7, wherein a closed portion of each of the end sections of the light source envelope comprises an elongated quartz stub of substantially rectangular cross-section extending therefrom to provide mechanical support.

12. The UV curing lamp assembly of claim 7, wherein the elongated stub has a substantially rectangular shape and is keyed to fit in only one orientation of the primary reflector wherein a major axis of an ellipse of the cross-section of the light source is aligned with the major axis of the elliptical cross-section of the primary reflector.

13. The UV curing lamp assembly of claim 12, wherein each of the end reflectors comprises a spring-loaded substantially rectangular receptacle.

14. The UV curing lamp assembly of claim 7, wherein the primary reflector comprises a plurality of openings for receiving microwave radiation to excite and cool the light source.

15. The UV curing lamp assembly of claim 7, wherein each tapered section has a cross-section that transitions from substantially elliptical at a junction with a corresponding end section to substantially circular at a junction with a corresponding end of the central section.

* * * * *